US008567870B2

(12) United States Patent
Junker et al.

(10) Patent No.: US 8,567,870 B2
(45) Date of Patent: Oct. 29, 2013

(54) METHOD FOR THE CONTROLLED MAINTAINING OF A DISTANCE BETWEEN THE TOP CANOPY AND THE COAL FACE IN LONGWALL MINING OPERATIONS

(75) Inventors: Martin Junker, Rheinberg (DE); Armin Mozar, Hamm (DE)

(73) Assignee: RAG Aktiengesselschaft (DE)

( * ) Notice: Subject to any disclaimer, the term of this patent is extended or adjusted under 35 U.S.C. 154(b) by 387 days.

(21) Appl. No.: 12/918,476

(22) PCT Filed: Feb. 19, 2008

(86) PCT No.: PCT/EP2008/001263

§ 371 (c)(1),
(2), (4) Date: Aug. 19, 2010

(87) PCT Pub. No.: WO2009/103304

PCT Pub. Date: Aug. 27, 2009

(65) Prior Publication Data

US 2010/0320827 A1 Dec. 23, 2010

(51) Int. Cl.
*E21C 35/08* (2006.01)

(52) U.S. Cl.
USPC ..... 299/1.7

(58) Field of Classification Search
USPC ..... 405/302; 299/1.6, 1.7
See application file for complete search history.

(56) References Cited

U.S. PATENT DOCUMENTS

| | | | | |
|---|---|---|---|---|
| 4,228,508 | A | 10/1980 | Benthaus | |
| 4,427,321 | A | 1/1984 | Weirich et al. | |
| 4,755,084 | A | 7/1988 | Peters et al. | |
| 4,798,417 | A * | 1/1989 | Blumenthal et al. | 299/1.7 |
| 4,887,935 | A | 12/1989 | Koppers et al. | |
| 5,423,638 | A * | 6/1995 | Merriman | 405/292 |
| 5,743,679 | A | 4/1998 | Gottschlich | |
| 6,056,481 | A | 5/2000 | Watermann et al. | |
| 2003/0075970 | A1 * | 4/2003 | Hainsworth et al. | 299/1.6 |
| 2009/0035072 | A1 * | 2/2009 | Koenig et al. | 405/288 |

FOREIGN PATENT DOCUMENTS

| | | |
|---|---|---|
| DE | 1209981 | 2/1986 |
| DE | 3620880 | 6/1987 |
| DE | 4122568 | 5/1992 |
| DE | 9416656 | 12/1994 |
| GB | 2090896 | 7/1982 |

* cited by examiner

*Primary Examiner* — David Bagnell
*Assistant Examiner* — Kyle Armstrong
(74) *Attorney, Agent, or Firm* — Becker & Stachniak, P.C.; Robert Becker

(57) ABSTRACT

A method for maintaining, in a controlled manner, a top canopy/coal-face distance expedient for rock mechanics, in longwall mining operations in underground coal mining, using a face conveyor, at least one extraction machine, and a hydraulic shield support frame. Inclination sensors are disposed on at least three of the four main components of the shield support frame, including floor skid, gob shield, support connection rods and gob-side area of the top canopy. An inclination of the top canopy and floor skid are ascertained via the sensors. From the ascertained inclination data, in a computer, the effects on a top canopy/coal face distance are determined when changes in an angle of inclination of the top canopy occur. An automatic adjustment of decisive cycle parameters of the shield support frame are carried out, wherein the work cycle comprises retraction, advancement and setting processes.

18 Claims, 5 Drawing Sheets

METHOD FOR THE CONTROLLED MAINTAINING OF A DISTANCE BETWEEN THE TOP CANOPY AND THE COAL FACE IN LONGWALL MINING OPERATIONS

BACKGROUND OF THE INVENTION

The instant application should be granted the priority date of Feb. 19, 2008, the filing date of the corresponding International patent application PCT/EP2008/001263.

The invention relates to a method for controlling longwall operations, having a face conveyor, at least one extraction machine, and a hydraulic shield support, in underground coal mining.

One problem in the automation of longwall controllers is, inter alia, the control of the top canopy-coal face distance, which is referred to hereafter in short as "CaCo". In general, efforts are made in underground operations of coal mining, after exposure of an overlying strata surface, to support this overlying strata surface as early as possible by appropriate supports, in order to reduce the danger, which exists for reasons of the rock mechanics, of an outbreak of the overlying strata in the area not supported by supports. Because of the operating sequence during the extraction, overlying strata areas without a support foundation necessarily occur in longwall operations. Thus, for example in the case of cutting extraction using a disc shearer loader, the shield support must initially maintain a distance from the coal face at the coal-face-side end of its top canopy so that it is possible for the disc shearer loader to travel past without colliding with the support. If the front disc of the disc shearer loader in the march direction, which typically leads, has cut into the upper stratum of the seam and exposed the overlying strata, it is only possible to advance the shield support at a certain distance behind the disc shearer loader traveling ahead, so that in this area the overlying strata is not supported by the shield support. The distance between the coal-face-side end of the top canopy of the shield support frame and the coal face (CaCo) which thus results depending on the operating state in the longwall operation, i.e., the freely protruding span width of the overlying strata between the coal face and its bearing on the shield support, decisively influences the danger of breakouts in the overlying strata. Any breakout can result in an impairment of the extraction operation, in particular in the case of the desired automation of extraction and support work.

The invention is therefore based on the object of disclosing a method of the type cited at the beginning, using which the top canopy-coal face distance (CaCo) is monitored during advance of the longwall front with respect to a minimization of the breakout danger and is settable.

SUMMARY OF THE INVENTION

The achievement of this object results, including advantageous embodiments and refinements of the invention, from the content of the claims which are appended to this description.

In its basic idea, the invention provides that for the controlled maintaining of a top canopy-coal face distance which is favorable for rock mechanics, the inclination of top canopy and floor skid in the mining direction is ascertained using inclination sensors attached to at least three of the four main components of each shield support frame, such as floor skid, gob shield, supporting connection rods, and gob-side area of the top canopy, and the effects on the top canopy-coal face distance are determined on the basis of the measured data in a computer unit in the event of occurring changes in the angle of inclination of the top canopy and an automatic adaptation of the decisive or crucial parameters during the work cycle of the shield support frame, consisting of a retracting, advancing, and setting process, occurs.

The advantage is connected to the invention that it is primarily possible, solely on the basis of the angle of inclination of the individual shield support frames in the mining direction, which is to be ascertained with comparatively little effort, to draw conclusions about the resulting top canopy-coal face distance, in the specific case, for an affected shield support frame, its work cycle being able to be set during stepping and/or advancing by the computer unit in an automated sequence in such a manner that a top canopy-coal face distance which is to be viewed as optimal under the applicable boundary conditions results.

According to one exemplary embodiment of the invention, it is provided that in addition to the ascertainment of the angle of inclination in the mining direction, the inclination of the individual shield support frames laterally to the mining direction is also ascertained using the inclination sensors and is compared to the ascertained lateral inclination of adjacent shield support frames and, in the event of a value above a value set as permissible during the work cycle, an orientation of the particular shield support frame in relation to its adjacent shield support frames is performed. It is thus to be ensured that the individual adjacent shield support frames do not have strong differences in their angle to the face conveyor, so that the adjacent shield support frames do not leave their mutual bracing during an automatic sequence. If impermissible deviations are established, upon recognition of a corresponding critical overlap situation, the work cycle during stepping of the shield support frame can be automatically adapted and/or terminated, so that a correction of the position of the individual shield support frame is possible. Undesired tilting of a shield support frame also results, inter alia, in an increase of the CaCo, so that this measure also ensures the control of the desired least possible CaCo.

In that the effective resulting CaCo during individual operating states is a function of the bearing of the overlying strata on the shield support frame, the occurrence of a rock cushion resting on the top canopy has the result that the overlying strata cannot bear on the coal-face-side front end of the top canopy, but rather first bears on the rock cushion typically forming in the rear area of the top canopy. For this reason, the formation of such rock cushions is to be avoided. For this purpose, it is provided according to one exemplary embodiment of the invention that during each work cycle of the shield support frame, the top canopy is set so that a decline of the top canopy results from its coal-face-side end to its gob-side end. In the case of a declining position of the top canopy of this type, a forming rock cushion is stripped off in each case during the stepping of the shield support frame. The control of the position of the top canopy can be performed in the specific case with the aid of corner cylinders situated on the shield support frame, these corner cylinders being situated between the top canopy and the gob shield so that the top canopy can be oriented in its position.

This desired position of the shield support frame can also be facilitated according to one exemplary embodiment in that during each work cycle of the shield support frame, the inclination of the floor skid is set so that rising of the floor skid toward the face conveyor results, because sliding on the debris which possibly forms on the footwall is facilitated by a skid which rises slightly in the mining direction. This sliding can be intentionally caused on the basis of the knowledge of the shield position brought about by the inclination sensors through a lift device set up in a known way on the shield support frame.

If a breakout of the overlying strata has occurred in the area located in front of the coal-face-side end of the top canopy, the danger exists that the coal-face-side end of the top canopy will enter the breakout area; in such a case, a position of the top canopy of this type is recognized by a change in the inclination of the top canopy occurring between two work cycles, if an essentially linear course of the overlying strata can still be assumed in the case of a seam horizontal. If an inclination of the top canopy in the direction of the breakout thus results, during the next work cycle, the coal-face-side end of the top canopy will remain hanging or catch in the breakout and will thus obstruct the further stepping movement or enlarge the breakout. To avoid this effect, it is provided according to one exemplary embodiment of the invention that upon establishment of a change in the inclination of the top canopy in the mining direction which occurs between two work cycles, the top canopy is only set with an inclination which corresponds to the position of the top canopy in a preceding work cycle during the next following work cycle. The same procedure also results if, after traveling under the breakout, the rear, gob-side end of the canopy pivots into the breakout, whereby tilting of the top canopy toward the face conveyor would result. The top canopy is also to be set having the predefined inclination in such a case.

It can be provided for this purpose that the extension height of the prop of the shield support frame supporting the top canopy is detected and the particular vertical location of the top canopy to the floor skid is considered in the individual work cycles for determining the required location of the top canopy.

The automatic support work is made more difficult in the cases in which the shield support frames are equipped with a so-called post-setting contdisc. This post-setting contdisc automatically ensures setting of the shield support frame until the props which press the top canopy against the overlying strata have reached a working pressure of 300 bar, for example. Upon the presence of breakouts or yielding overlying strata areas of the overlying strata, this has the result that the post-setting contdisc automatically presses against the top canopy until a corresponding solid resistance has resulted. When traveling through breakout zones, tilting of the top canopy thus occurs almost automatically. In order to avoid this, it is provided according to one exemplary embodiment of the invention that the placement action of the shield support frame is automatically ended when the inclination sensor of the top canopy displays an incorrect position of the top canopy in comparison to its position in a preceding work cycle. Furthermore, it can be provided according to an exemplary embodiment of the invention that subsequently a post-setting contdisc set up in the case of one shield support frame is automatically deactivated for the following work cycle and reactivated for the next following work cycle. Incorrect positions caused by the automatic setting of shield support frames are avoided by these measures.

In order that the position of the individual shield support frame in relation to the face conveyor and the extraction machine guided on the face conveyor can be detected, it is provided according to one exemplary embodiment of the invention that the stepping distance of the stepping cylinder, which causes the shield support frame to be shafted or pulled after the face conveyor, is acquired via a distance measuring device.

In that an appropriate CaCo, which is determined by the technical design of the longwall equipment, must be maintained to avoid collisions when the extraction machine travels past the shield support frames, a change of this CaCo always occurs if, in particular when traveling through a trough or when traveling over a saddle, the angle of inclination of face conveyor and extraction machine changes in relation to the inclination of the individual shield support frame. In order to recognize such changes in a timely manner and compensate for them by corresponding control measures, it is provided according to one exemplary embodiment of the invention that an inclination sensor is situated in each case on the face conveyor and/or extraction machine and the angle of inclination of face conveyor and/or extraction machine in the mining direction is ascertained. Situating an inclination sensor on the extraction machine is sufficient in this case. Although the extraction machine traveling on the face conveyor and guided thereon forms a type of unit with the face conveyor, it can be expedient, for improving the precision of the control, to also acquire the inclination of the face conveyor via an inclination sensor situated thereon. If necessary, situating an inclination sensor solely on the face conveyor is sufficient for the purpose of control.

In this context, it is provided that in the event of established deviations in the angles of inclination of face conveyor and extraction machine, on the one hand, and shield support frame, on the other hand, the differential angle between the footprints of face conveyor and shield support frame is ascertained. This differential angle expresses whether face conveyor and extraction machine, on the one hand, and shield support frame, on the other hand, are moving on a common plane in the mining direction, or whether a relative position of face conveyor with extraction machine and shield support frame to one another results because of a change of the seam decline.

If the differential angle is less than 180° during a trough passage, exhausting the full stepping distance of the shield support frame which is valid for the normal operating sequence would result in a collision with the extraction machine, so that it is provided according to an exemplary embodiment of the invention that in the case of an established differential angle of less than 180°, the stepping distance of the shield support frame to the face conveyor during the work cycle is reduced in such a manner that a passage of the extraction machine in front of the coal-seam-side top tip of the top canopy is possible.

If a differential angle of greater than 180° occurs when traveling over a saddle, the CaCo is undesirably enlarged because of the position of face conveyor and extraction machine and shield support frame to one another, so that in this case the leading of face conveyor with extraction machine in relation to the shield support frame must be reduced, in order to thus limit the CaCo. For this purpose, it is provided according to an exemplary embodiment of the invention that in the case of an established differential angle of greater than 180°, the shifting distance of the face conveyor to the coal seam when the shield support frame is advanced and thus the cutting width of the extraction machine is reduced in such a manner that during the passage of the extraction machine, a lesser top canopy-coal face distance results in comparison to the normal cutting width of the extraction machine.

Situations of this type are better controllable if it is provided according to an exemplary embodiment of the invention that the stroke of the stepping cylinder is set greater than the cutting width of the extraction means, because this solution also allows the top canopy-coal face distance to be prevented from growing to an excessively large amount.

The same considerations for controlling the CaCo also apply for embodiments of longwall equipment in which the top canopy can be lengthened using an advancing sliding top extendable in the direction of the coal seam, if an inclination sensor is also situated in the advancing sliding top and the extension dimension of the advancing sliding top can be acquired via a distance measuring system situated in the advancing sliding top.

If the protrusion of the coal-seam-side end of the top canopy changes as a function of the extension height of the prop of the shield support frame because of the lemniscate error caused by the position of the supporting connection rods situated between floor skid and gob shield in the case of a shield support frame implemented as a lemniscate shield, it is provided that this error is considered as a correction factor during the determination of the CaCo.

BRIEF DESCRIPTION OF THE DRAWINGS

Exemplary embodiments of the invention, which are described hereafter, are shown in the drawing. In the figures.

DESCRIPTION OF SPECIFIC EMBODIMENTS

Figure 1:
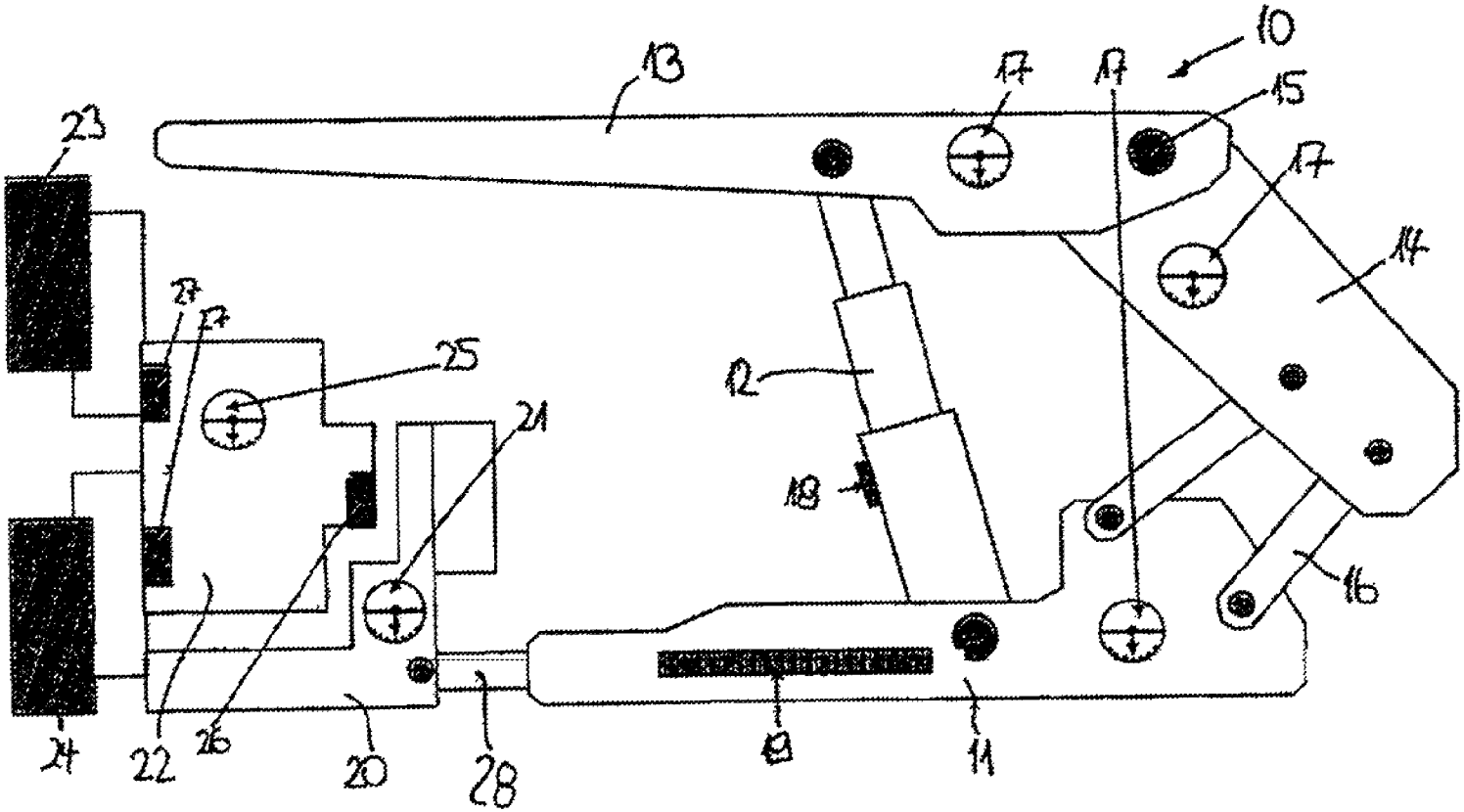
FIG. 1 shows a shield support frame having inclination sensors situated thereon in connection with a face conveyor and a disc shearer loader, used as an extraction machine, in a schematic side view.

The longwall equipment shown in FIG. 1 primarily comprises a shield support frame 10 having a floor skid 11 on which two props 12 are attached in a parallel configuration, of which only one prop is recognizable in FIG. 1, which carries a top canopy 13 on its upper end. While the top canopy 13 protrudes in the direction of the extraction machine (to be described hereafter) at its front (left) end, a gob shield 14 is linked on the rear (right) end of the top canopy 13 using a joint 15, the gob shield being supported by two supporting connection rods 16, which rest on the floor skid 11 in the side view. In the exemplary embodiment shown, three inclination sensors 17 are attached to the shield support frame 10, one inclination sensor 17 on the floor skid 11, one inclination sensor 17 in the rear end of the top canopy 13 in proximity to the joint 15, and one inclination sensor 17 on the gob shield 14. As is not shown in greater detail, an inclination sensor can also be provided on the fourth movable component of the shield support frame 10, the connection rods 16, three inclination sensors having to be installed of the four possible inclination sensors 17 in each case, in order to determine the position of the shield support frame in a working area using the inclination values ascertained therefrom. The invention is thus not restricted to the concrete configuration of the inclination sensors shown in FIG. 1, but rather comprises all possible combinations of three inclination sensors on the four movable components of the shield support frame. The stepping distance of the stepping cylinder 28, which causes the shield support frame to be shafted or pulled after the face conveyor, is acquired via a distance measuring device 19.

The shield support frame 10 shown in FIG. 1 is fastened to a face conveyor 20, which also has an inclination sensor 21, so that in general data with respect to the conveyor location can also be obtained here in regard to the control of the longwall equipment. An extraction machine in the form of a disc shearer loader 22 having an upper disc 23 and a lower disc 24 is guided on the conveyor 20, an inclination sensor 25 also being situated in the area of the disc shearer loader 22, as well as a sensor 26 for detecting the particular location of the disc shearer loader 22 in the longwall and reed bars 27 for measuring the cutting height of the disc shearer loader 22.

Figure 2:
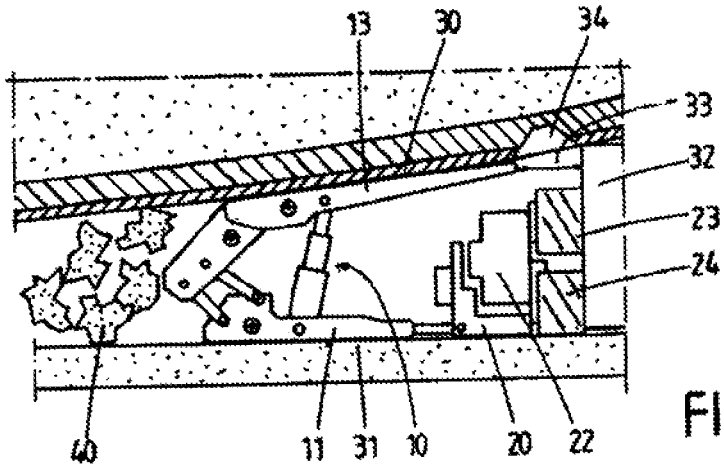
FIG. 2 shows the longwall equipment from FIG. 1 in use in a schematic view.

As shown in FIG. 2, the use of the longwall equipment described in FIG. 1 in a longwall operation is represented in such a manner that the longwall equipment is pressed on the footwall 31, the discs 23 and 24 of the disc shearer loader 22 extracting in the coal face 32. The overlying strata 30 is supported by the top canopy 13 of each shield support frame 10, the overlying strata 30 falling in as gob 40 after longwall passage with progressive extraction. The CaCo (top canopy-coal face distance) existing in each individual operating situation between the tip of the coal-seam-side top canopy 13 and the coal seam or face 32, which is a measure for the protruding and non-supported area 34 of the overlying strata 30, is shown in FIG. 2, this area 34 fundamentally to be viewed as in danger of breakout.

Figure 3:
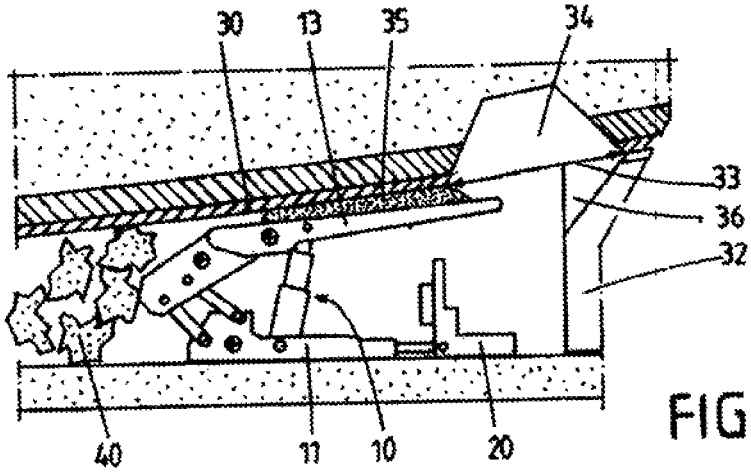
FIG. 3 shows the longwall equipment from FIG. 2 in the case of an overlying strata breakout of the overlying strata to be feared because of a rock cushion resting on the top canopy.

As shown in FIG. 3, the CaCo 33 enlarges when a rock cushion 35, which forms the bearing for the overlying strata 30, forms on the top canopy 13 of the shield support frame 10. In the exemplary embodiment shown in FIG. 3, a bulge 36 has occurred simultaneously in the area of the upper stratum of the coal seam 32, and it is recognizable how a substantially larger CaCo 33 results without a fundamentally different position of the longwall equipment in comparison to FIG. 2, so that the area 34 in danger of breakout is significantly enlarged.

Figure 4:
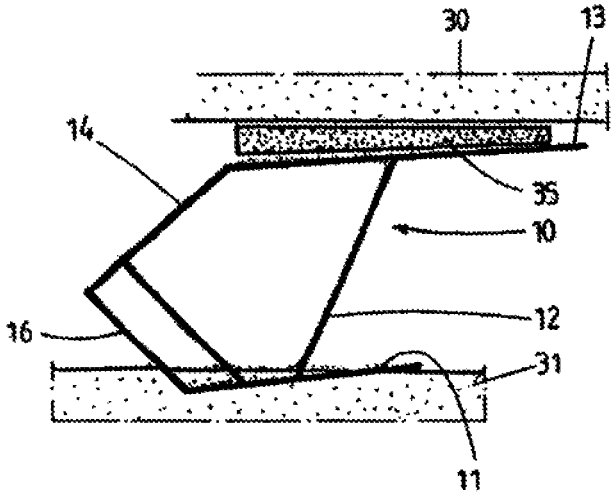
FIG. 4 shows the target position of the shield support frame to prevent a rock cushion from forming on the top canopy in a schematic view.

It is recognizable from FIG. 4 that in the case of a progressively set inclination of the top canopy 13 with a decline from its coal-seam-side end in the direction toward the gob side 40, a forming rock cushion 35 is stripped off in each case during the stepping action. Simultaneously, it is recognizable in the area of the floor skid 11, that the floor skid 11 is to be placed with a slightly rising angle in the mining direction 38 toward the face conveyor 20, because in this way the sliding on the debris lying on the footwall 31 is facilitated. These measures may specifically be implemented by corner cylinders (not individually shown, however), which are situated on the shield support frame 10, between the top canopy 13 and the gob shield 14 and by a lifting device, which is known per se, in the area of the floor skid 11 (so-called base lift).

If the occurrence of a rock cushion on the top canopy is thus avoided because of the procedure according to the invention, a smaller CaCo 33 accordingly results.

Figure 5:
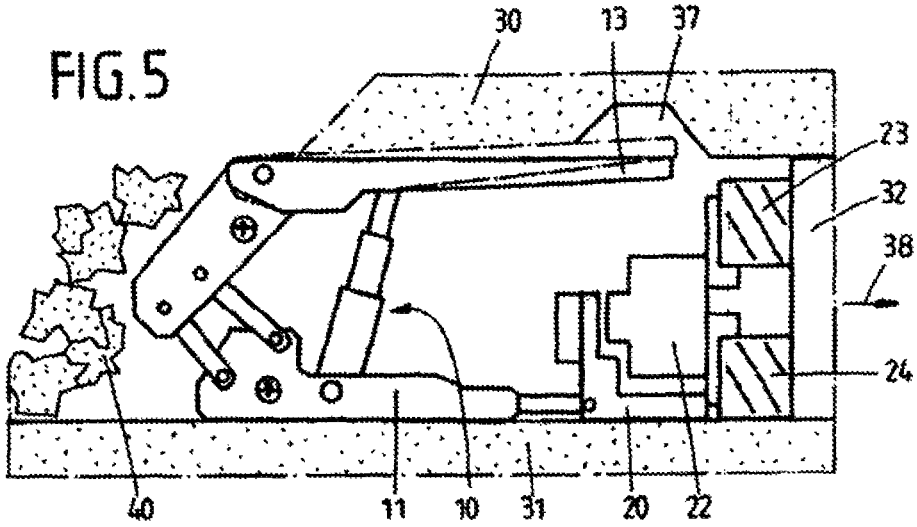
FIG. 5 shows a support situation from FIG. 2 in the case of an occurring overlying strata breakout.
Figure 6:
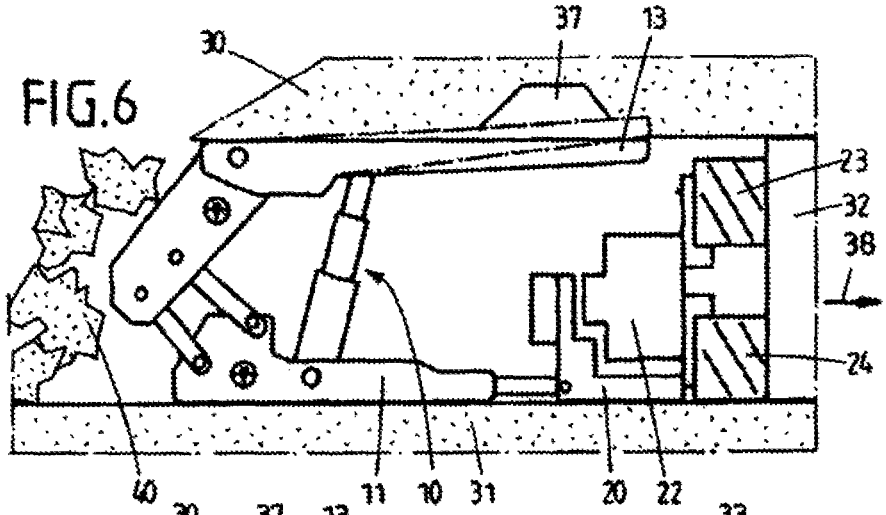
FIG. 6 shows the support situation from FIG. 5 in the case of traveling below an overlying strata breakout.
Figure 7:
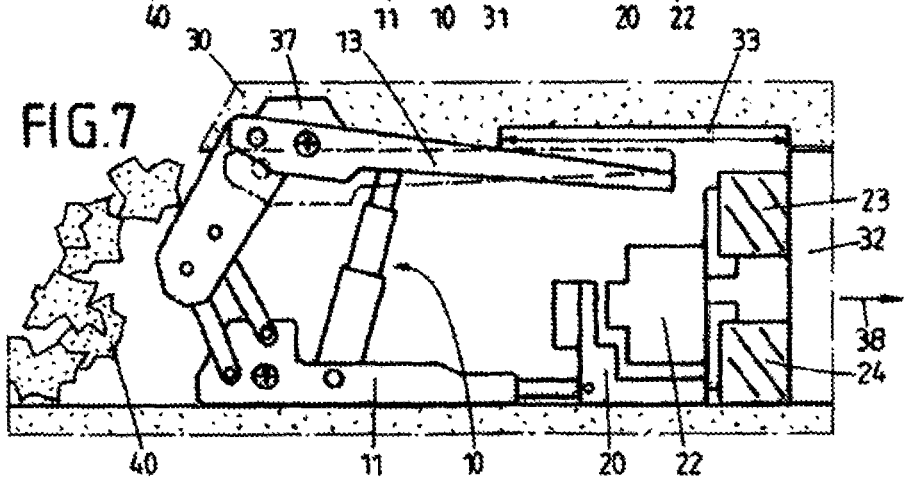
FIG. 7 shows the support situation from FIGS. 5 and 6 in a following work cycle.

The passage of the longwall equipment through an overlying strata area of the overlying strata having a breakout 37 is shown in FIGS. 5 through 7. For this purpose, it is recognizable from FIG. 5 that if a breakout 37 has occurred, the danger exists that the coal-seam-side end of the top canopy 13 will move into the breakout 37, and this procedure can be detected on the basis of the inclination sensor 17 located on the top canopy 13. As a further identification feature for the presence of a breakout in the overlying strata, the change of the vertical location of the top canopy 13 can also be used by establishing the extension height of the props 12 for example by situating corresponding sensors 18 on the props 12. If the top canopy 13 assumes the schematically indicated position having a protrusion into the breakout 37, it is obvious that—as also indicated in FIG. 6—the top canopy 13 abuts the coal-seam-side end of the breakout 37 and would either obstruct the further steps of the shield support frame 10 or would enlarge the breakout 37. In order to avoid a disadvantageous consequence of this type, it is provided that the top canopy 13 is only set to an extent and/or having the inclination which it also had in the preceding work cycles with full-surface contact on the overlying strata 30, so that the top canopy 13 does not pivot into the breakout 37. The top canopy 13 will thus travel below the breakout 37, as schematically shown in FIG. 6. If the coal-seam-side end of the top canopy 13 comes back into contact against the overlying strata 30, no inclination tendency still results with respect to tilting of the top overlying strata 13, and this can be tapped as a signal that it has traveled below the breakout 37.

In the same way, a situation to be noted occurs in a following work cycle if, as is obvious from FIG. 7, the rear area of the top canopy 13 arrives below the breakout 37, because this rear area then also tends to move into the breakout 37 because of the prop pressure, so that corresponding tilting of the top canopy 13 in the mining direction 38 results. This situation is also controllable, in that the top canopy 13 is only set having its inclination assumed in the preceding work cycle.

While the exemplary embodiments shown in FIGS. 2 to 7 relate to the control of the actually occurring CaCo, the technically required CaCo is to be differentiated therefrom, which results from the design of the longwall equipment per se. This technical CaCo corresponds to the safety distance which the top canopy 13 must maintain when the face conveyor 20 is moved against the coal seam 32, in order to avoid a collision between the shearer disc 23 and the canopy 13 during passage of the extraction machine 22 traveling on the face conveyor 20. If the decline conditions of the seam change, which can be connected to a passage through troughs or a passage over saddles, different inclination positions of shield support frame and face conveyor having extraction machine to one another result in a change of the CaCo, which falls below or also exceeds the technically required CaCo. Upon falling below the technically required CaCo, a danger of collision exists between extraction machine and shield support frame, and upon exceeding the technically required CaCo, the danger of a breakout of the unsupported overlying strata surface rises.

Figure 8:
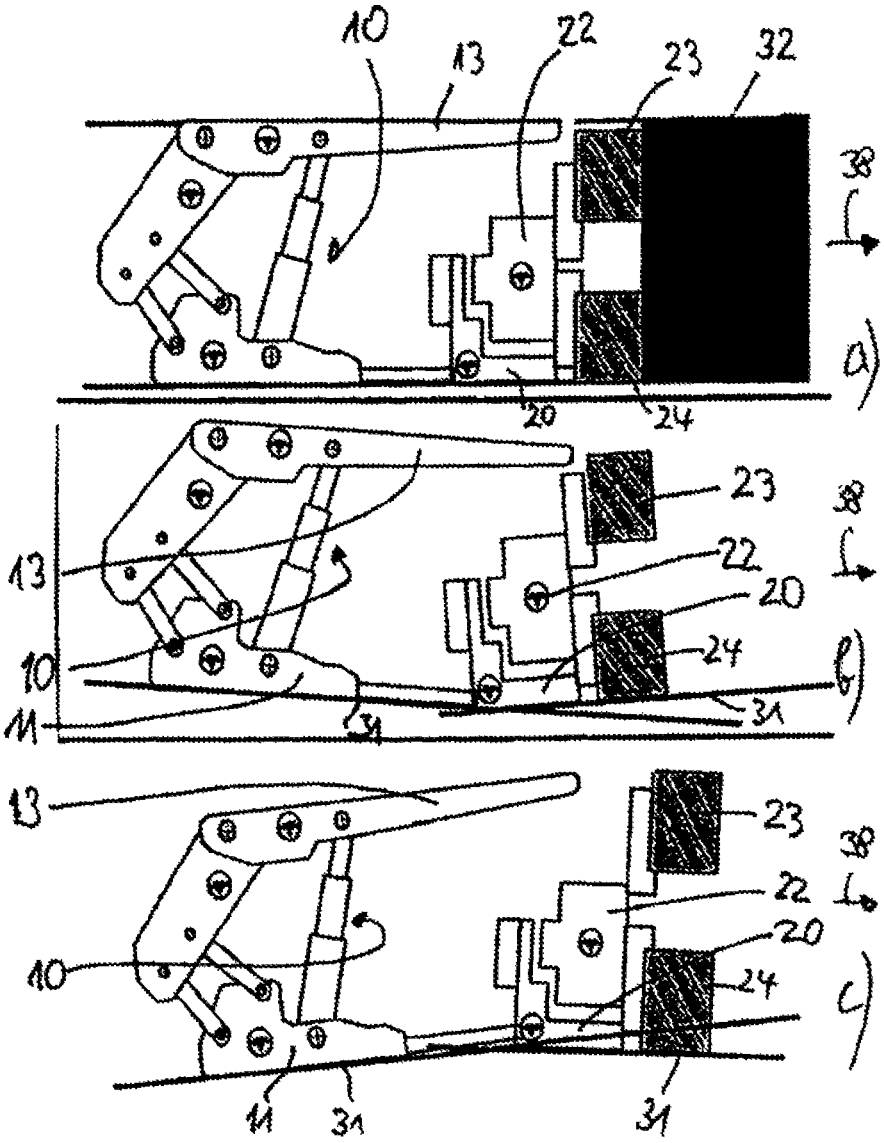
FIGS. 8*a-c* shows the influence of traveling through troughs and traveling over saddles on the CaCo in a schematic illustration.

As shown on the basis of the individual views according to FIGS. 8*a* to 8*c*, an undesired change of the CaCo occurs when traveling through troughs and traveling over saddles. As first shown from a comparison of FIG. 8*b* with FIG. 8*a*, approaching a trough (FIG. 8*b*) results in an inclined position of face conveyor 20 and extraction machine 22, which is detectable via inclination sensors 21 and 25 situated thereon, respectively. The inclination values recorded here may be compared to the inclination values recorded on the shield support frame 10, and a differential angle results therefrom, which can be related to the particular footprint of the stepping support frame 10 and the face conveyor 20 having extraction machine 22 on the footwall 31. During the travel through the trough shown in FIG. 8*b*, a differential angle of less than 180° results, and this has the result that the distance still existing in FIG. 8*a* between the coal-seam-side end of the top canopy 13 and the extraction machine 22 decreases, and thus also the resulting CaCo (not shown in greater detail here). In order to neutralize the collision risk connected thereto, it is provided according to the invention that in such a situation, the shield support frame 10 is not pulled behind by the full amount, but rather remains somewhat to the rear in relation to the face conveyor 20 having extraction machine 22, so that the distance or CaCo required for technical reasons is maintained.

A reverse situation results when traveling over a saddle, as shown in FIG. 8*c* in comparison with FIG. 8*a*. A differential angle of greater than 180° results in this case, which means that in the overlying strata area, the distance between top canopy 13 and extraction machine 22, thus also the CaCo, is laid open. In order to prevent the CaCo from becoming excessively large here, it is provided that in the automatic sequence, the shield support frame 10 is drawn forward by the full stepping distance, but the cutting width of the extraction machine 22 is reduced. With correspondingly set up monitoring of the technically required CaCo and traveling mode of the longwall equipment adapted thereto, it is advantageously possible to reduce the so-called "sticking", i.e., the distance between the shield support frame 10 and the face conveyor 20, so that the top canopy 13 protrudes further in the direction of the coal seam 32 and the CaCo 33 is thus reduced. Because the "sticking" is also changeable in running operation, the automatic operation of the longwall equipment can be adapted depending on mineral deposit conditions, in that the advance of the shield support frames 10 is controlled enough that the technically required CaCo is maintained.

Figure 9:
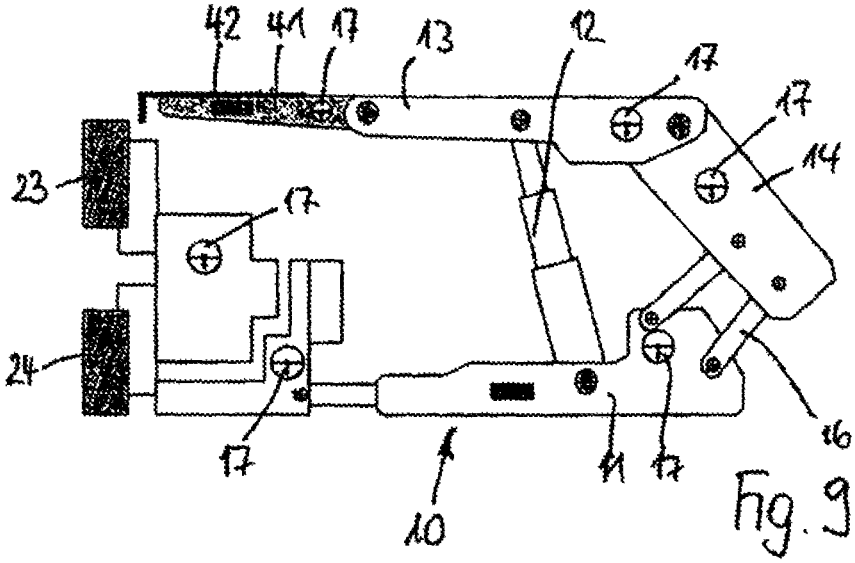
FIG. 9 shows the longwall equipment from FIG. 1 having a shield support frame having an additional advancing sliding top.

As shown in FIG. 9, shield support frames 10 are also known which have an advancing sliding top 41 in the area of their top canopy 13. The invention may also be implemented using such shield support frames 10, and it is provided for this purpose that an inclination sensor 17 and a distance measuring system 42 are also situated in the advancing sliding top 41, so that the position of the advancing sliding top 41 in relation to the floor skid 11 can be taken into consideration in the automatic sequence control of the work cycle of the shield support frame 10.

Figure 10:
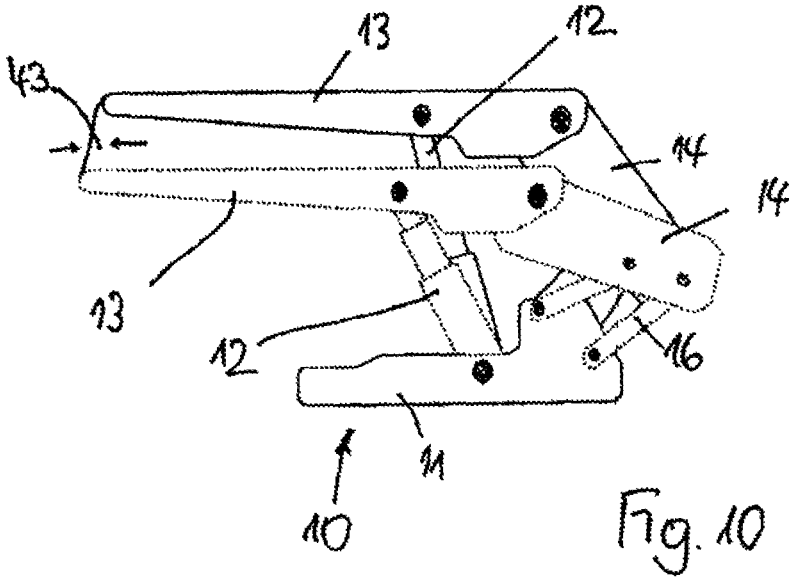
FIG. 10 shows an illustration of the so-called lemniscate error in the case of a shield support frame implemented as a lemniscate shield.

A further error correction in the context of the application according to the invention is possible upon the use of so-called lemniscate shields, in which the location of the coal-seam-side end of the top canopy 13 changes as a function of the extension height of the shield, and the lemniscate error, which is indicated by 43 in FIG. 10, is to be considered accordingly in the ascertainment of the CaCo in the specific case.

The requirements for the control of the top canopy-coal face distance in automated operation of the shield support frames may also be improved in that design changes may be executed on the shield support frames during repair and maintenance work performed above ground. This also applies in particular for new designs of shield support frames, in which the requirements of automated support operation may be considered from the beginning.

The features of the subject matter of this application disclosed in the above description, the claims, the abstract, and the drawing may be essential both individually and also in arbitrary combinations with one another for the implementation of the invention in its various embodiments.

The specification incorporates by reference the disclosure of International application PCT/EP2008/001263, filed Feb. 19, 2008.

The present invention is, of course, in no way restricted to the specific disclosure of the specification and drawings, but also encompasses any modifications within the scope of the appended claims.

The invention claimed is:

1. A method for maintaining, in a controlled manner, a top canopy/coal face distance (33) that is expedient for rock mechanics, in longwall mining operations in underground coal mining, including the steps of:

providing a face conveyor;

providing at least one extraction machine;

providing a hydraulic shield support frame that includes, as main components, a floor skid arrangement, a gob shield, a top canopy, and support connection rods;

disposing inclination sensors on at least three of the group consisting of said floor skid arrangement, said gob shield, said support connection rods, and a gob-side region of said top canopy;

ascertaining via said inclination sensors an inclination of said top canopy and said floor skid arrangement in a direction of mining;

in a computer, determining from the ascertained inclination data the effects on a top canopy/coal face distance when changes in an angle of inclination of said top canopy occur;

carrying out an automatic adjustment of decisive work cycle parameters of said shield support frame, wherein said work cycle comprises reaction, advancement, and setting processes, to effect a controlled maintenance of said top canopy/coal face distance, such that a top canopy-coal face distance which is to be viewed as optimal under the applicable boundary conditions results.

2. A method according to claim 1, which includes a plurality of shield support frames, and which includes the further steps of: ascertaining an inclination of individual ones of said shield support frames transverse to the direction of mining by means of said inclination sensors, comparing this ascertained inclination with an ascertained transverse inclination of adjacent ones of said shield support frames, and if said comparison results in a value that is above a permissible set value during a work cycle, carrying out an orientation of the respective shield support frame in relation to adjacent ones of said shield support frames.

3. A method according to claim 1, which, during each work cycle of said shield support frame, includes the further step of setting said top canopy such that a decline of said top canopy results from a coal-seam-side thereof to a gob-side end thereof.

4. A method according to claim 3, which includes the further step of effecting control of a position of said top canopy with the aid of corner cylinders disposed on said shield support frame.

5. A method according to claim 1, further including the step of setting an inclination of said floor skid arrangement during each work cycle of said shield support frame, such that a rise of said floor skid arrangement toward said face conveyor results.

6. A method according to claim 5, which includes the further step of effecting control of the position of said floor skid arrangement with the aid of a lifting device disposed on said shield support frame.

7. A method according to claim 1, which, upon determination of a change in the inclination of said top canopy in the direction of mining occurring between two work cycles, includes the further step, during the subsequent work cycle, of imparting to said top canopy an inclination that corresponds to the position of said top canopy in a preceding work cycle.

8. A method according to claim 7, which includes the further steps of detecting an extension height of a prop of said shield support frame that supports said top canopy, and taking into account a respective height position of said top canopy relative to said floor skid arrangement in individual ones of said work cycles for a determination of a required position of said top canopy.

9. A method according to claim 7, which includes the further step of automatically terminating a setting procedure of said shield support frame if said inclination sensor of said top canopy indicates an incorrect position of said top canopy in comparison to the position of said top canopy in a preceding work cycle.

10. A method according to claim 9, which includes the further steps of subsequently automatically deactivating a post-setting control in said shield support frame for a following work cycle, and again activating said post-setting control for a next following work cycle.

11. A method according to claim 7, which includes the further step of detecting, via a distance-measuring device, a stepping distance of stepping cylinders that effect a shifting of said shield support frame toward said face conveyor.

12. A method according to claim 11, which includes the further step of setting a stroke of said stepping cylinders to be greater than a cutting width of said at least one extraction machine.

13. A method according to claim 7, which includes the further steps of disposing a respective further inclination sensor on at least one of said face conveyor and said at least one extraction machine, and ascertaining an angle of inclination of at least one of said face conveyor and said at least one extraction machine in the direction of mining.

14. A method according to claim 12, which, when deviations in the angles of inclination of said face conveyor and said at least one extraction machine, on the one hand, and said shield support frame, on the other hand, are established, includes the further step of ascertaining a differential angle between a footprint of said face conveyor and a footprint of said shield support frame.

15. A method according to claim 14 which, when the established differential angle is less than 180°, includes the further step of reducing a stepping distance of said shield support frame to said face conveyor during the working cycle in such a way that a passage of said at least one extraction machine in front of a coal-seam-side tip of said top canopy is possible.

16. A method according to claim 14, which, when the established differential angle is greater than 180°, includes the further step of reducing a shifting distance or stepping path of said face conveyor toward a coal seam, when said shield support frame is advanced, in such a manner that during passage of said at least one extraction machine a maximum prescribed top canopy/coal face distance results.

17. A method according to claim 1, which includes the further steps of lengthening said top canopy by means of an advancing sliding top that is extendable in the direction of a coal seam, disposing a further inclination sensor on said advancing sliding top, and detecting an amount of extension of said advancing sliding top via a distance measuring system disposed in said advancing sliding top.

18. A method according to claim 1, wherein a lemniscates error that occurs as a function of an extension height of said shield support frame is taken into account during the determination of said top canopy/coal face distance.

* * * * *